US005171174A

United States Patent [19]

Mynster

[11] Patent Number: 5,171,174

[45] Date of Patent: Dec. 15, 1992

[54] FOOT SWITCH MECHANISM FOR TRANSOM-MOUNTED TROLLING MOTORS

[75] Inventor: Richard J. Mynster, Kansas City, Kans.

[73] Assignee: RM Industries, Inc., Kansas City, Kans.

[21] Appl. No.: 852,735

[22] Filed: Mar. 16, 1992

[51] Int. Cl.[5] ..... B63H 5/12

[52] U.S. Cl. ..... 440/7; 114/153; 440/62

[58] Field of Search ..... 114/160, 161, 153; 440/7, 62

[56] References Cited

U.S. PATENT DOCUMENTS

| | | | |
|---|---|---|---|
| 530,154 | 12/1894 | Allen | 114/161 |
| 1,767,584 | 6/1930 | Hammer | 114/160 |
| 2,545,086 | 3/1951 | Harris | 114/153 |
| 3,561,393 | 2/1971 | Fortson | 440/7 |
| 3,580,212 | 5/1971 | Fortson | 440/7 |
| 3,598,079 | 8/1971 | Cudley | 114/153 |
| 3,889,625 | 6/1975 | Roller et al. | 114/153 |
| 4,348,193 | 9/1982 | Arndt | 440/62 |
| 4,527,983 | 7/1985 | Booth | 114/153 |
| 4,669,987 | 6/1987 | Schulte | 440/6 |
| 4,950,187 | 8/1990 | Smith | 440/7 |

*Primary Examiner*—Jesus D. Sotelo
*Assistant Examiner*—Thomas J. Brahan
*Attorney, Agent, or Firm*—Hovey, Williams, Timmons & Collins

[57] ABSTRACT

A foot operated steering mechanism (12) for conventional trolling motors (10) is provided which can be readily retrofitted to the motor (10) without interfering with normal manual control and steering of the motor (10). The steering mechanism (12) includes a pivotal plate (52) mounted proximal to the steering shaft (22) of the motor (10), along with a flexible, strap-like connector (72) secured to the plate (52) and shaft (22). A foot operated actuator (16) is connected via a cable (106) to plate (52), so that selective shifting of the actuator (16) effects corresponding pivoting of the shaft (22).

1 Claim, 2 Drawing Sheets

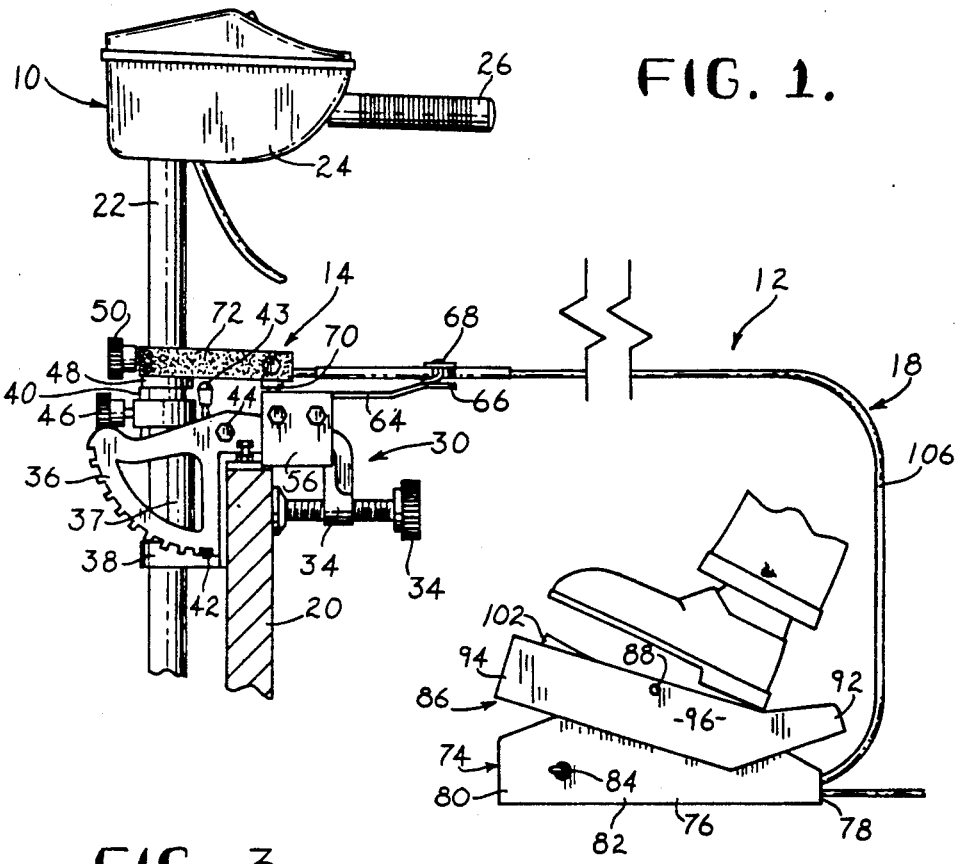
FIG. 1.
FIG. 3.
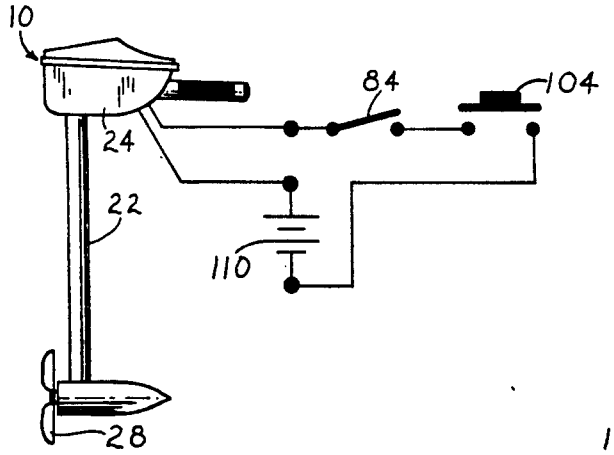
FIG. 2.
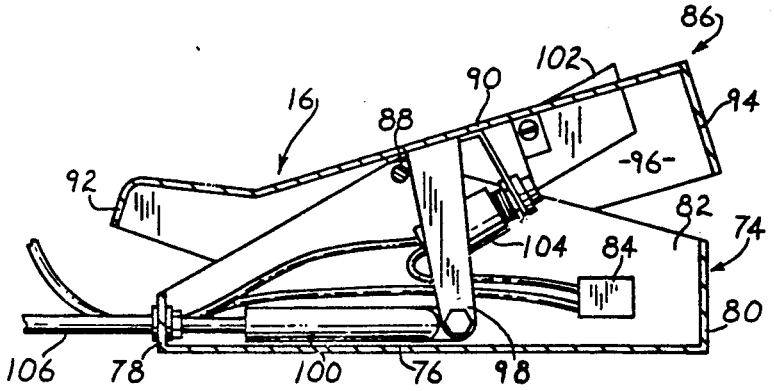

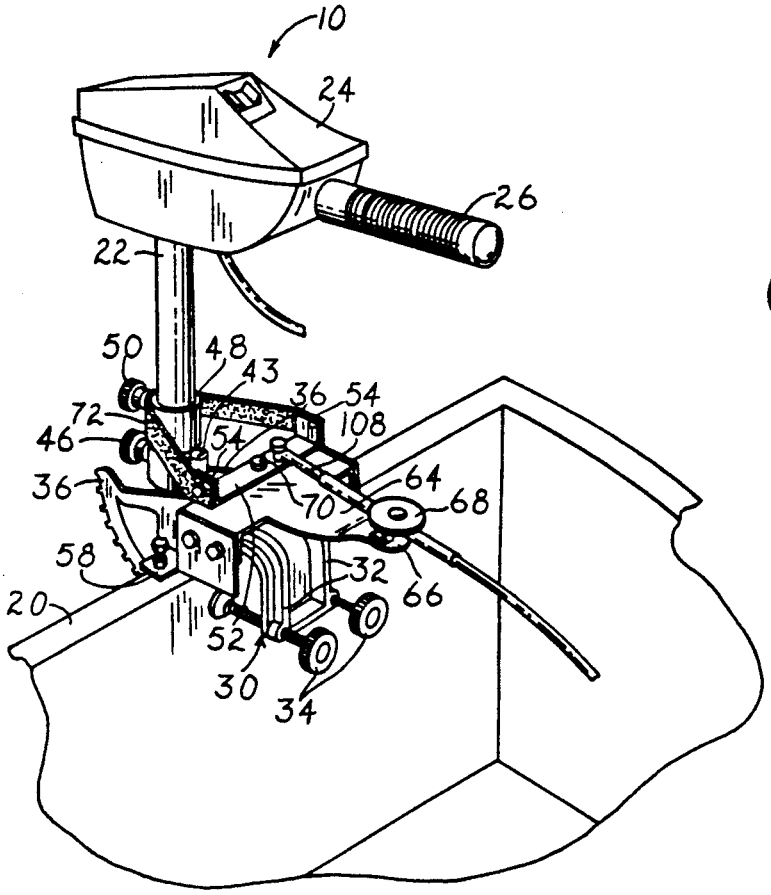
FIG. 4.
FIG. 5.
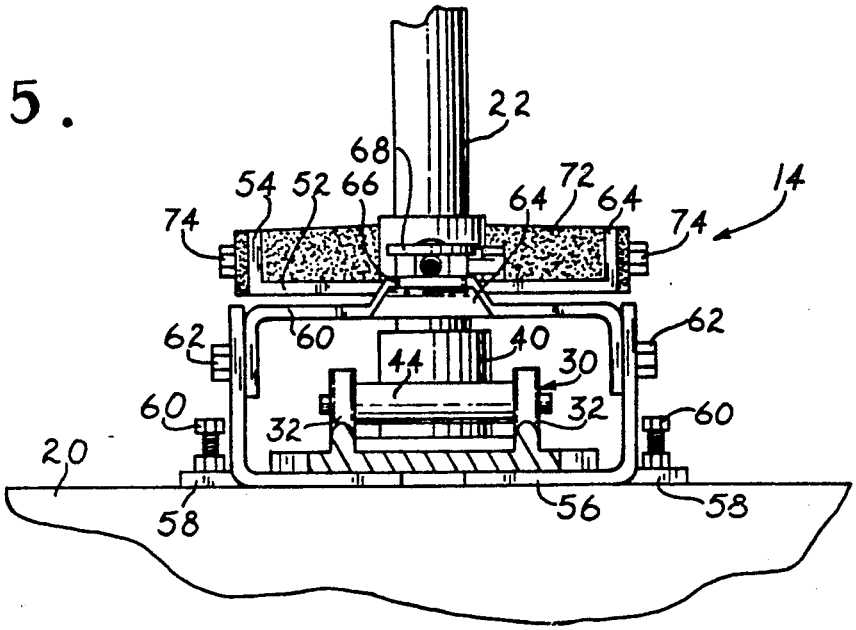

FOOT SWITCH MECHANISM FOR TRANSOM-MOUNTED TROLLING MOTORS

This is a continuation of copending application Ser. No. 07/516,167 filed on Apr. 30, 1990, now abandoned.

BACKGROUND OF THE INVENTION

1. Field of the Invention

The present invention is broadly concerned with an improved foot-operated steering mechanism for trolling motors, allowing steering control of a trolling motor mounted at any location (e.g. bow or transom) on a boat while at the same time permitting manual up and down and/or tilting adjustment of the motor. More particularly, it is concerned with such a steering mechanism which allows a fisherman to readily steer a transom-mounted trolling motor using a convenient foot-operated actuator, without the need to modify or in any way impair the normal manual operation and adjustment capabilities of the motor.

2. Description of the Prior Art

Many fishermen make use of small electric outboard motors to slowly maneuver a boat during fishing. Inasmuch as the fishing itself may require the use of both hands, a foot-operated device for steering control can be a decided advantage.

U.S. Pat. No. 4,569,663 describes a steering device making use of a foot operated plate along with an elongated, rigid link coupled between the operating plate and the upright steering shaft of a trolling motor. A prime deficiency of this type of steering device is that it interferes with manual adjustment and steering of the motor, i.e., the usual functions of up and down and tilting adjustment, and manual steering, are severely impaired. U.S. Pat. No. 3,807,345 describes another type of foot operated steering control. However, this device is essentially limited to use with trolling motors mounted adjacent the bow of a boat; in many instances however, fishermen prefer transom-mounted trolling motors.

SUMMARY OF THE INVENTION

The present invention overcomes the problems outlined above, and provides a greatly improved foot-steering mechanism which can be used with trolling motors mounted at any desired location on a boat, while not interfering with the normal manual adjustment and steering functions of the motor. Broadly speaking, the steering mechanism of the invention includes an elongated plate mounted proximal to the upright steering shaft of the trolling motor for pivoting movement of the plate about an upright axis spaced from the motor shaft. A flexible strap-type connector is secured adjacent the opposed ends of the pivotal plate and is adapted for securement to the motor shaft for pivoting of the latter in response to plate pivoting. The mechanism further includes actuator means having a shiftable foot operated member, along with coupling means (advantageously in the form of an elongated operating cable including an inner, shiftable cable section) connected between the foot operated member and the pivotal plate.

In use, a fisherman need only depress the foot plate in a desired direction for effecting corresponding pivoting movement of the plate; this in turn serves to pivot the motor shaft through the medium of the flexible strap connector. Advantageously, the foot actuator also includes a separate electrical switch for on-off operation of the motor propeller.

BRIEF DESCRIPTION OF THE DRAWINGS

FIG. 1 is a fragmentary view illustrating the steering mechanism of the invention, operatively associated with a transom-mounted trolling motor;

FIG. 2 is a sectional view illustrating the internal construction of the foot actuator forming a part of the steering mechanism;

FIG. 3 is a schematic representation of the on-off electrical control circuitry for the motor;

FIG. 4 is a perspective view illustrating a transom-mounted trolling motor having the steering mechanism of the invention associated therewith; and FIG. 5 is an enlarged, fragmentary, vertical sectional view illustrating a portion of the steering mechanism.

DESCRIPTION OF THE PREFERRED EMBODIMENT

Turning now to the drawings, and particularly FIG. 1, a trolling motor 10 is illustrated together with a foot-operated steering mechanism broadly referred to by the numeral 12. As illustrated, the mechanism 12 includes a pivoting assembly 14 adjacent motor 10, a foot-operated actuator 16, and an elongated flexible connector 18 operatively coupled between the assembly 14 and actuator 16.

In more detail, it will be seen that motor 10 is supported on the transom 20 of a small fishing boat. The motor 10 includes the usual upright steering shaft 22 supporting at its uppermost end an electrical motor 24 and forwardly projecting tiller 26. A rotatable propeller 28 is secured to the lower end of shaft 22 (see FIG. 3).

The motor 10 is secured to transom 20 by means of a mounting bracket 30 having a pair of spaced apart, interconnected members 32 of inverted, somewhat U-shaped configuration, with a pair of clamping screws 34 extending through the lower forward ends of the members 32 for engaging the upright forward face of transom 20. In this fashion, the transom 20 is clamped between the rearward legs of the members 32 and the transom-engaging ends of the screws 34. A pair of spaced apart, interconnected, toothed sectors 36 extend rearwardly from the members 32 and are integral therewith. These sectors permit tilting adjustment of the motor 10 as will be described.

An elongated, shaft-receiving connector 37 including a lower collar 38 and upper collar 40 is situated between the sectors 36 as illustrated. The lower collar 38 is provided with a pair of outwardly extending, sector-engaging pins 42 controlled by means of lever 43. The upper end of the connector 37 adjacent collar 40 is rigidly secured to a cross pin 44, the latter being supported adjacent the upper ends of the members 32 for pivotal movement about a horizontal axis. As will be appreciated from the foregoing, motor 10 may be selectively pivoted about the axis defined by cross pin 44. This involves manipulation of lever 43, manual pivoting of the motor to a desired position, and locking the motor in this position through manipulation of lever 43. In order to secure shaft 22 within connector 37, a thumbscrew 46 is provided which extends through upper collar 40 and engages the shaft 22.

The motor shaft 22 is also provided with an uppermost, auxiliary collar 48 disposed above collar 40. A shaft-locking thumbscrew 50 also extends through auxiliary collar 48 and engages shaft 22. In order to vertically adjust motor 10, it is only necessary to loosen the thumbscrews 46, 50, whereupon shaft 22 may be manually moved upwardly or downwardly as desired, whereupon the thumbscrews 46, 50 are retightened.

The pivoting assembly 14 forming a part of the present invention includes an elongated, laterally extending plate 52 having a pair of upstanding terminal ends 54. The plate 52 is mounted for pivotal movement about an upright axis spaced from the axis defined by shaft 22. To this end, a pair of opposed L-brackets 56 are provided, with the lower horizontal legs thereof adapted to rest atop transom 20. The brackets 56 are clamped in place beneath mounting bracket 30 as best seen in FIG. 5. In addition, each of the L-brackets 56 is provided with an outwardly extending, apertured ear 58, and a locking screw 60 extends through each ear apertured for engagement with transom 20.

An uppermost cross plate 61 extends between and is interconnected with the upper ends of the L-brackets 56, such being effected by means of connectors 62. Cross plate 61 includes a forwardly extending tongue 64 having an upraised, forwardmost platform 66. A conventional, pivotal connector cable mount 68 is secured to platform 66. A pivot pin 70 serves to pivotally secure plate 52 to cross plate 61 (see FIG. 4).

A flexible strap-like connector element 72 is secured to the ends 54 of plate 52 by screws 74. The element 72 extends around shaft 22 and in particular engages auxiliary collar 48. The connector element 72 is apertured to accommodate thumbscrew 50, thereby ensuring a positive connection between the element 72 and the steering shaft 22 of motor 10.

Actuator 16 includes a lowermost stationary section 74 having bottom wall 76, end walls 78, 80, and upright, somewhat triangularly shaped sidewalls 82. An on-off switch 84 extends through one sidewall 82 as seen in FIGS. 1 and 2. The actuator 16 also has an upper shiftable member 86 pivotally coupled to lower section 64 by means of cross pin 88. The member 86 includes an apertured top plate 90 end walls 92, 94 and depending sidewalls 96.

An elongated, rigid operator leg 98 depends from the underside of top plate 90 and has a cable connector 100 pivoted thereto. A foot operated motor controller 102 extends through the aperture provided by top plate 90 and is configured to actuate electrical switch 104 mounted within the confines of the actuator 16.

An elongated, flexible connector cable 106 serves to operatively interconnect actuator 16 and plate 52. The cable 106 is conventional and includes a central, axially shiftable cable section 108. One end of the section 108 is secured to plate 52 as shown, whereas the remaining end thereof is coupled with connector 100 within actuator 16. In order to control undue movement of the cable, the latter passes through and is received by cable mount 68.

Turning next to FIG. 3, the electrical control for trolling motor 10 is schematically illustrated. In particular, the motor 10 is powered by means of battery 110, the latter being wired through the switches 82 and 104 to electric motor 24.

The operation of the steering mechanism will next be described, it being understood that for purposes of illustration, only the motor 10 is shown mounted to the transom 20. In any event, when it is desired to energize the trolling motor 10 it is only necessary to close switch 84 and depress controller 102 to close switch 104. When this is done, battery 110 serves to operate the motor and rotate propeller 28. When it is desired to steer motor 10 through the foot actuator 16, it is only necessary to depress top plate 92 in a desired pivotal direction. That is, if the plate 92 is pivoted in a clockwise direction as viewed in FIG. 2, operator leg 98 is correspondingly moved so as to extend cable section 108. This in turn serves to pivot plate 52 steering shaft 22. On the other hand, depression of plate 90 in a direction to pivot the latter in a counterclockwise direction as viewed in FIG. 2 serves to retract cable section 108, thereby pivoting plate 52 in the opposite direction. This correspondingly pivots the steering shaft 22. During such pivoting movement it will be appreciated that one side of the connector 68 is under tension to effect shaft pivoting, whereas the other slack side of the connector partially wraps about collar 48.

It will thus be seen that the present invention provides a greatly improved steering mechanism for trolling motors which permits easy steering using a remote foot-operated actuator while not detracting from a manual adjustability and steering of the motor. The steering mechanism of the invention can therefore by readily retrofitted to existing trolling motors without the need for motor modification of any sort.

I claim:

1. In combination:

a trolling motor including an elongated, upright steering shaft having a manipulable tiller adjacent the upper end thereof and a rotatable propeller supported proximal to the lower end thereof;

means mounting said motor to a boat hull including a hull clamping bracket having a depending leg section and configured to overlie the upper margin of said hull, clamping means carried by said leg section for engaging said hull, connector means for said steering shaft including a shaft-receiving collar, means operably coupling said connector means to said hull clamping bracket for pivoting movement of the connector means about an axis transverse to the longitudinal axis of said steering shaft for permitting selective tilting movement of the steering shaft about said transverse axis, means for releasably locking said steering shaft at any one of a number of tilted positions, and structure for releasably holding said steering shaft within said collar for permitting selective axial shifting thereof within the connector means in order to alter the vertical position of said steering shaft;

a pivoting assembly including a support member having a mounting portion situated between said hull clamping bracket and said boat hull for clamping the support member against the boat hull, an elongated plate positioned above said hull and pivotally coupled with said support member for selective pivotal movement of the plate about an upright axis separate from and proximal to said steering shaft, a flexible strap-like connector element secured to the ends of said plate and extending around and engaging said steering shaft, said straplike element having a length less than the length of said steering shaft, and means connecting said element to said steering shaft at a point remote from said plate;

a foot-operated actuator including a shiftable component engageable by an operator's foot; and an elongated, flexible connector cable having an axially shiftable section operatively connected between said shiftable component and said plate for pivoting of said plate in response to movement of said component, said strap-like element being operable for maintaining the connection between the element and said shaft in any of said tilted positions of said steering shaft, said strap-like element also being operable to partially wrap about said shaft upon manual axial movement of the steering shaft effected through manipulation of said tiller, in order to permit selective, alternate pivoting of the steering shaft either manually through tiller manipulation or remotely through shifting of said component.

* * * * *

UNITED STATES PATENT AND TRADEMARK OFFICE

CERTIFICATE OF CORRECTION

PATENT NO. : 5,171,174

DATED : December 15, 1992

INVENTOR(S) : Richard J. Mynster

It is certified that error appears in the above-indentified patent and that said Letters Patent is hereby corrected as shown below:

On the title page item [22], "Filed: Mar. 16, 1992"
On the title page insert item [63] and the following text:

--Related U.S. Application Data

Continuation of Ser. No. 516,167, Apr. 30, 1990, abandoned.--

Signed and Sealed this

Twenty-seventh Day of June, 1995

*Attest:*

Bruce Lehman

BRUCE LEHMAN

*Attesting Officer*

*Commissioner of Patents and Trademarks*